US006902240B1

(12) United States Patent
Lin

(10) Patent No.: US 6,902,240 B1
(45) Date of Patent: Jun. 7, 2005

(54) WHEEL FOR AN IN-LINE SKATE

(76) Inventor: Chia-Yen Lin, 6F., No. 82, Sec. 2, Jianguo North Rd., Taipei City (TW)

( * ) Notice: Subject to any disclaimer, the term of this patent is extended or adjusted under 35 U.S.C. 154(b) by 0 days.

(21) Appl. No.: 10/758,986

(22) Filed: Jan. 16, 2004

(51) Int. Cl.[7] ..... B60B 3/10
(52) U.S. Cl. ..... 301/64.201; 301/5.3; 152/327
(58) Field of Search ..... 301/64.701, 64.702, 301/64.703, 64.704, 64.705, 64.706, 64.1, 301/5.3, 63.1; 152/310, 311, 47, 48, 49, 50, 152/165, 327, 328; 16/45, 46, 47

(56) References Cited

U.S. PATENT DOCUMENTS 4,153,303 A * 5/1979 Tanner ..... 301/64.706
4,818,034 A * 4/1989 Djerf ..... 301/64.706
5,551,763 A * 9/1996 Alsman ..... 301/64.706
5,922,151 A * 7/1999 Piper et al. ..... 152/310

* cited by examiner

*Primary Examiner*—Frantz F. Jules

(57) ABSTRACT

A wheel for an in-line skate includes a hub composed of two halves. Each half has a centrally defined axle hole, a hollow cylinder formed on a periphery defining the axle hole, multiple rods formed on the inner side face, multiple indents defined in the inner side face and alternate relative to the rods, multiple segmented protrusions formed on a face of the skirt, multiple cutouts defined in the face of the skirt and alternate relative to the segmented protrusions and slits defined in the face of the skirt and a tire securely mounted on an outer periphery of the hub. Thus the rods from one half are inserted into the indents of the other half and the segmented protrusions from one half are inserted into the cutouts of the other half and the assembly of the wheel is accomplished.

6 Claims, 6 Drawing Sheets

WHEEL FOR AN IN-LINE SKATE

BACKGROUND OF THE INVENTION

1. Field of the Invention

The present invention relates to a wheel, and more particularly to a wheel for an in-line skate to enable easy assembly and reduce manufacture cost.

2. Description of Related Art

A wheel used in the in-line skate usually is composed of a tire and a hub. Recently, due to the requirements of the young generation, the weight of the wheel becomes less and less. However, despite the effort in lessening the wheel weight, manufacture cost is still high. Furthermore, because of the complex structure of the hub, the assembly of the wheel is difficult and extremely labor intensive.

To overcome the shortcomings, the present invention intends to provide an improved in-line skate wheel to mitigate the aforementioned problems.

SUMMARY OF THE INVENTION

The primary objective of the invention is to provide an improved wheel for an in-line skate. The wheel is easily assembled and has a simple structure so that the manufacture cost is low and the labor involved is greatly reduced.

Other objects, advantages and novel features of the invention will become more apparent from the following detailed description when taken in conjunction with the accompanying drawings, in which:

DETAILED DESCRIPTION OF PREFERRED EMBODIMENT

Figure 1:
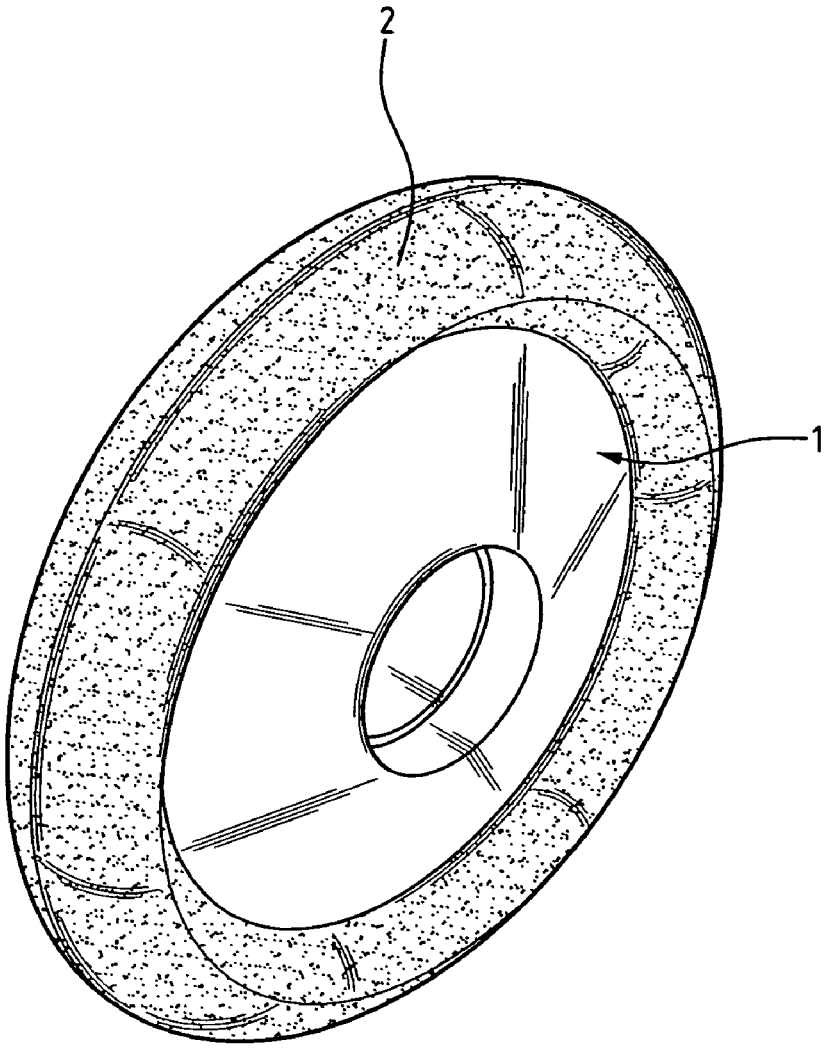
FIG. 1 is a perspective view of the wheel of the present invention.

With reference to FIG. 1, the wheel for the in-line skate and in accordance with the present invention includes a hub 1 and a tire 2. Preferably, the tire 2 is securely mounted on an outer periphery of the hub 1 and made of polyurethane (PU).

Figure 2:
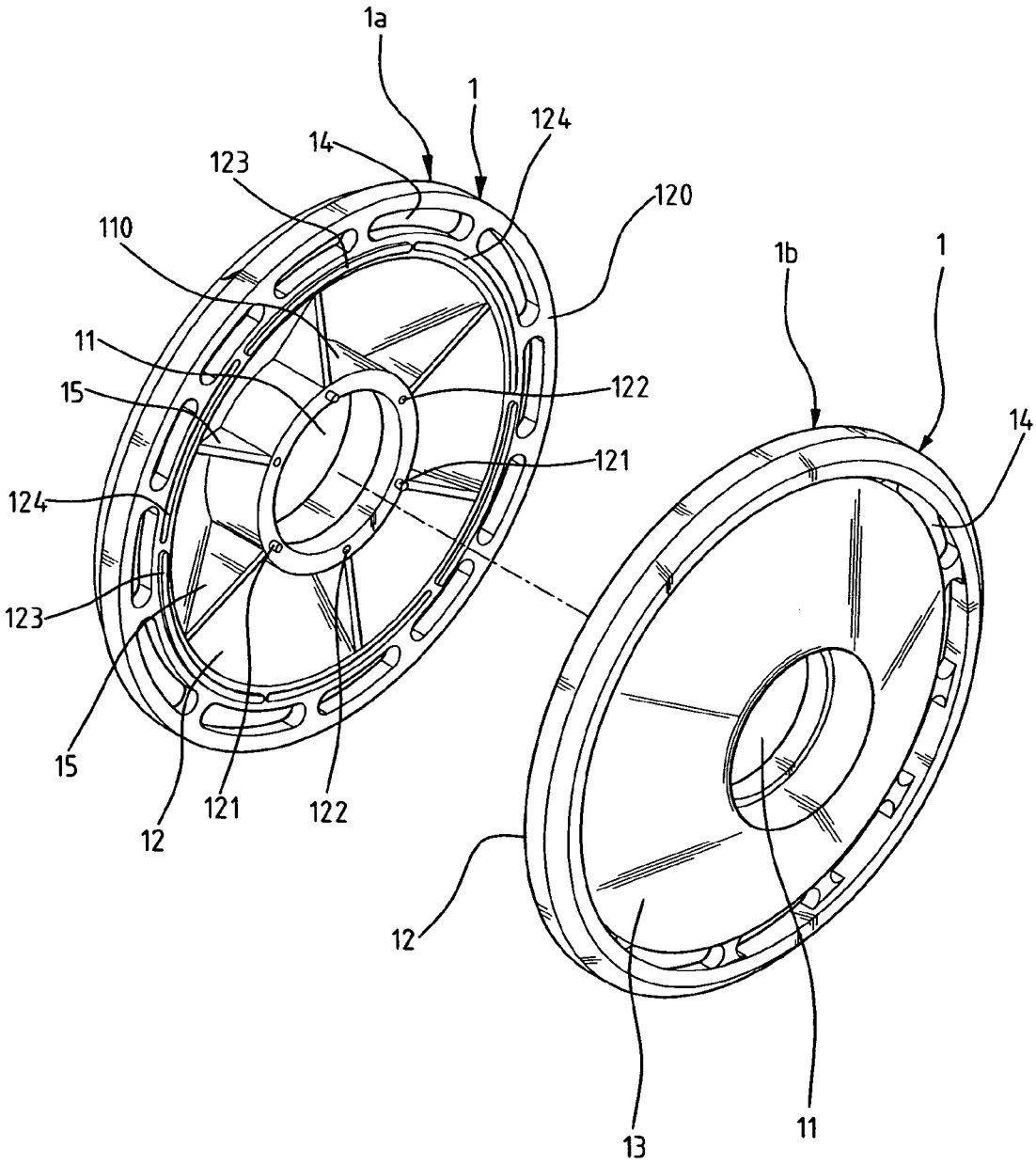
FIG. 2 is an exploded perspective view of the wheel of the present invention.

With reference to FIG. 2, the hub 1 is composed of two halves 1*a*, 1*b*. Each half 1*a*, 1*b* is identical in structure and shape. Therefore the following description focuses only on one half 1*a*, 1*b*.

The half hub 1*a*, 1*b* has a centrally defined axle hole 11, an inner side face 12 and an outer side face 13. The outer side face 13 is conical. The inner side face 12 has a hollow cylinder 110 formed around a periphery defining the axle hole 11, multiple rods 121 formed on a peripheral end face of the cylinder 110, multiple indents 122 defined on the peripheral end face of the cylinder 110 and being alternate relative to the rods 121, a skirt 120 formed and extended out from an outer periphery of the inner side face 12, multiple annular segmented protrusions 123 formed on a face of the skirt 120 and multiple cutout 124 defined in the face of the skirt 120 and being alternate relative to the protrusions 123. Preferably, there are slits 14 defined in the face of the skirt 120 to lessen the weight of the hub 1 and reinforcing plates 15 formed along an outer periphery of the hollow cylinder 110 and between a side face of both the protrusions 123 and the cutouts 124.

Figure 3:
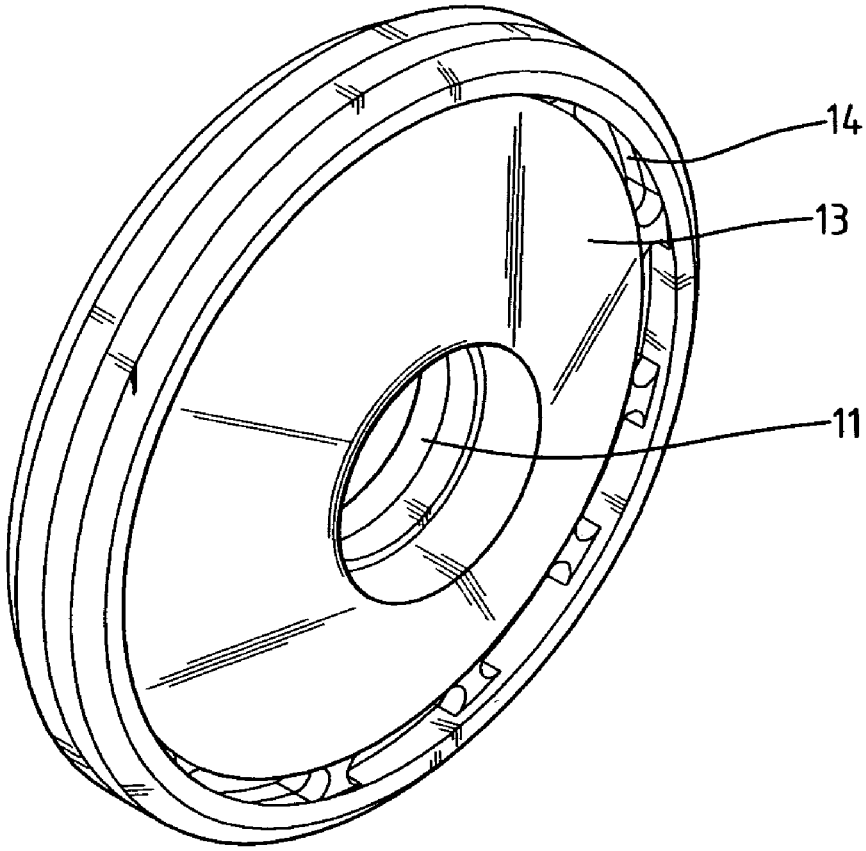
FIG. 3 is a perspective view of the hub of the wheel of the present invention.
Figure 4:
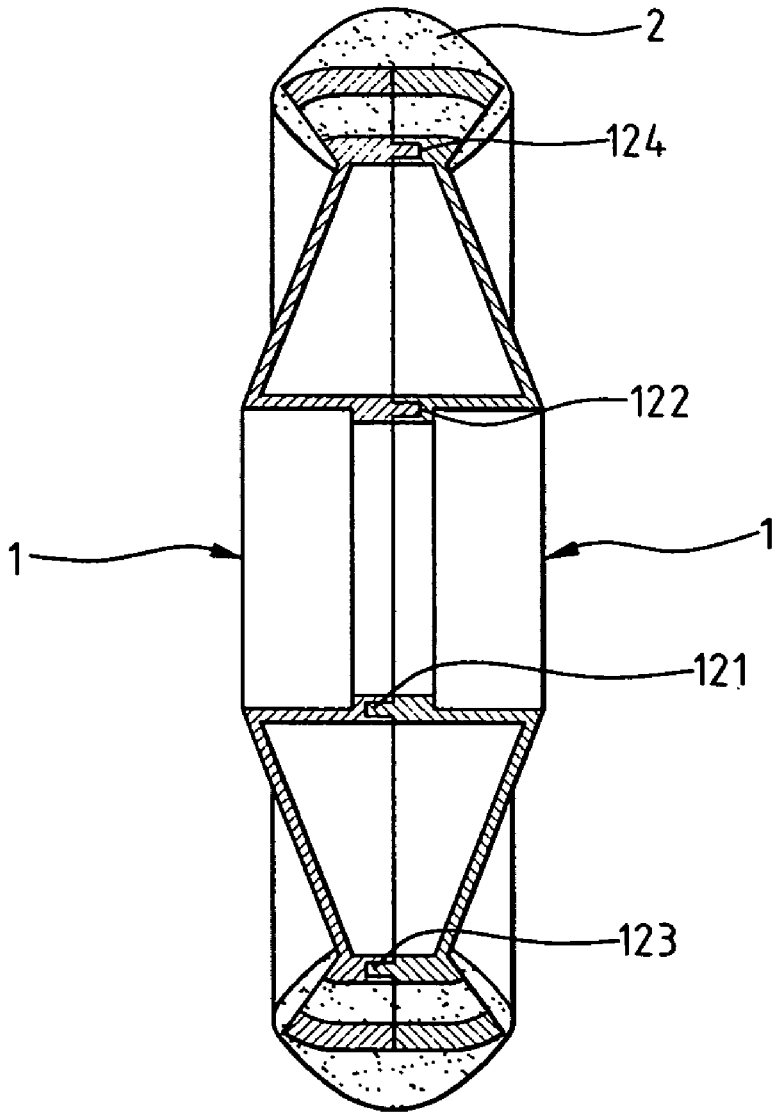
FIG. 4 is a cross-sectional view of the wheel of the present invention.

With reference to FIG. 4, when two halves 1*a*, 1*b* of the hub 1 are assembled, it is appreciated that the rods 121 from one half 1*a* are inserted into the corresponding indents 122 of the other half 1*b*. The protrusions 123 of one half 1*a* are inserted into the corresponding cutouts 124 of the other half 1*b*. Thereafter, the assembly of the hub 1 is finished and as shown in FIG. 3.

Figure 5:
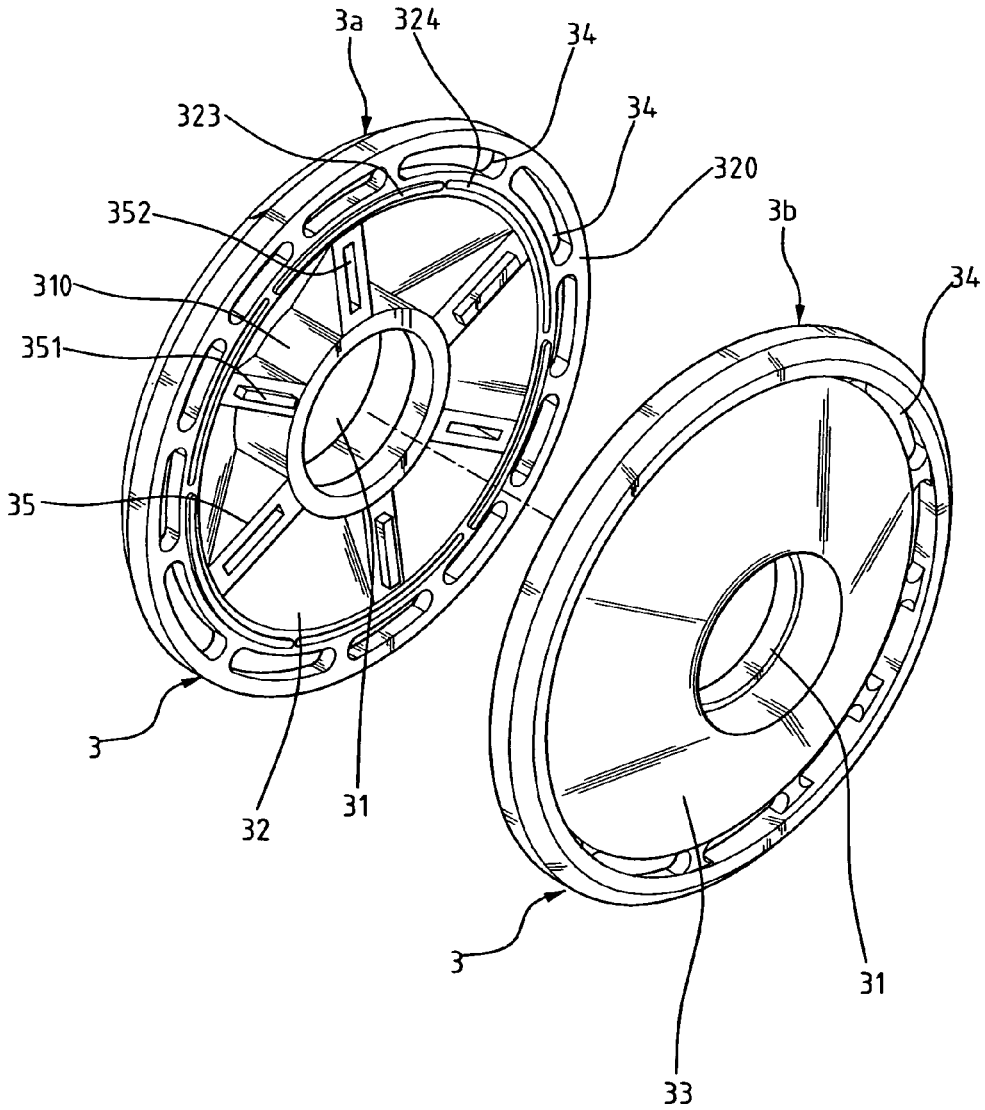
FIG. 5 is an exploded perspective view of another embodiment of the wheel of the present invention.

With reference to FIG. 5, a second embodiment of the hub 3 of the present invention is shown and includes two halves 3*a*, 3*b*. Each half 3*a*, 3*b* is identical in structure and shape. Therefore, the following description focuses only on one half 3*a*, 3*b*.

The half hub 3*a*, 3*b* has a centrally defined axle hole 31, an inner side face 32 and an outer side face 33. The outer side face 33 is conical. The inner side face 32 has a hollow cylinder 310 formed around a periphery defining the axle hole 31, a skirt 320 formed and extended out from an outer periphery of the inner side face 32, multiple annular segmented protrusions 323 formed on a face of the skirt 320 and multiple cutout 324 defined in the face of the skirt 320 and being alternate relative to the protrusions 323. Preferably, there are slits 34 defined in the face of the skirt 320 to lessen the weight of the hub 3 and reinforcing plates 35 formed along an outer periphery of the hollow cylinder 310 and between a side face of both the protrusions 323 and the cutouts 324. Multiple connecting blocks 351 are alternately formed on a top face of each of the reinforcing plate 35 and multiple indents 352 are also alternately defined in the top face of each of the reinforcing plate 35. Therefore, one connecting block 351 is adjacent to one indent 352.

When two halves 3*a*, 3*b* are assembled, the protrusions 323 from one half 3*a* are inserted into the cutouts 324 of the other half 3*b* and the connecting blocks 351 from one half 3*a* are inserted into the indents 352 of the other half 3*b*. Thus the assembly of the two halves 3*a*, 3*b* is completed.

Figure 6:
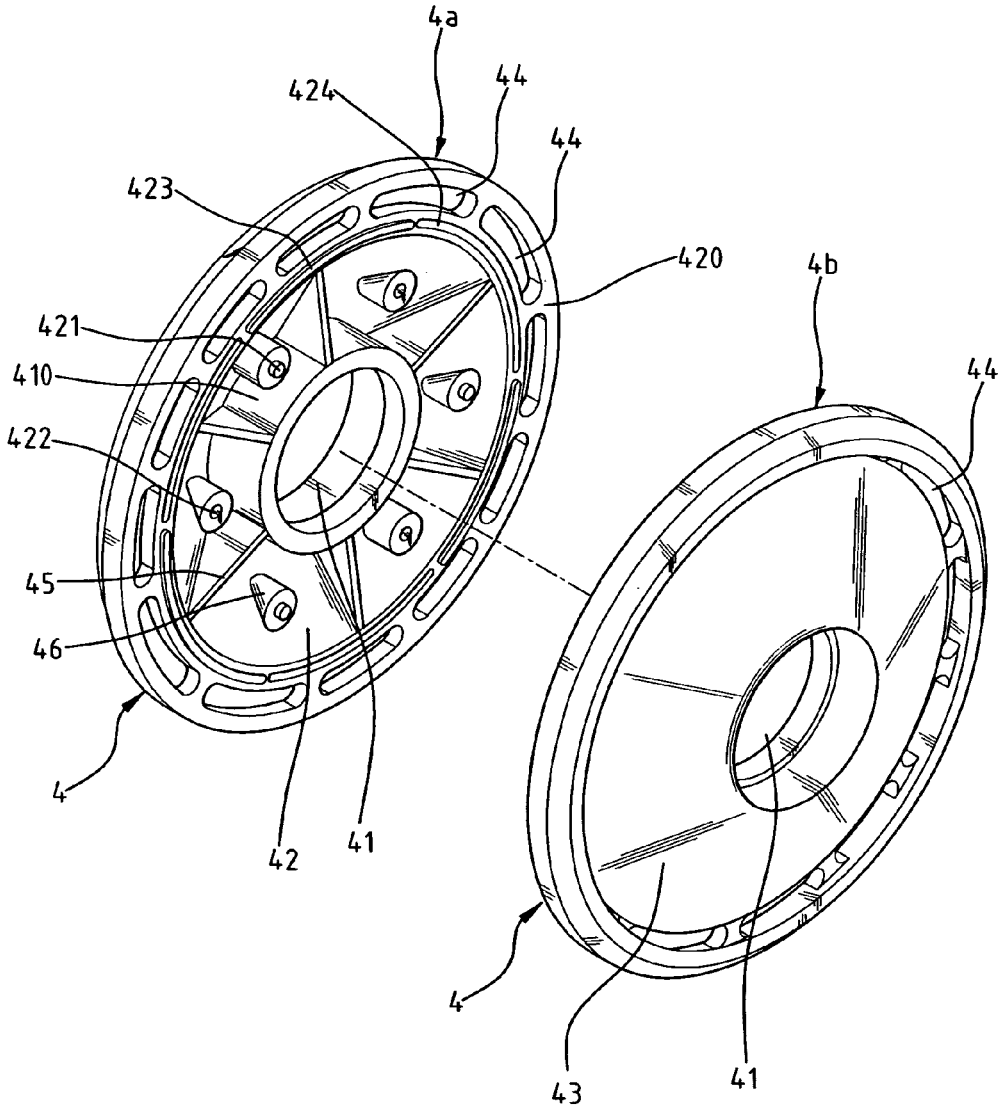
FIG. 6 is an exploded perspective view of still another embodiment of the wheel of the present invention.

With reference to FIG. 6, a third embodiment of the hub 4 is shown and composed of two halves 4*a*, 4*b*. The half hub 4*a*, 4*b* has a centrally defined axle hole 41, an inner side face 42 and an outer side face 43. The outer side face 43 is conical. The inner side face 42 has a hollow cylinder 410 formed around a periphery defining the axle hole 41, a skirt 420 formed and extended out from an outer periphery of the inner side face 42, multiple annular segmented protrusions 423 formed on a face of the skirt 420 and multiple cutout 424 defined in the face of the skirt 420 and being alternate relative to the protrusions 423. Preferably, there are slits 44 defined in the face of the skirt 420 to lessen the weight of the hub 4 and reinforcing plates 45 formed along an outer periphery of the hollow cylinder 410 and between a side face of both the protrusions 423 and the cutouts 424. Multiple secondary cylinders 46 are formed on the inner side face 43 and between two reinforcing plate 45. Multiple rods 421 and multiple indents 422 are formed on free ends of the secondary cylinders 46, wherein the rods 421 are alternate relative to the indents 422.

When two halves 4*a*, 4*b* are assembled, the protrusions 423 from one half 4*a* are inserted into the cutouts 424 of the other half 4*b* and the rods 421 from one half 4*a* are inserted into the indents 422 of the other half 4*b*. Thus the assembly of the two halves 4*a*, 4*b* is completed.

After the assembly of the hub of the present invention, it is noted that the assembly is easy and the manufacture cost is greatly reduced in mass production. Furthermore, when in comparison with a conventional wheel, the weight of the wheel of the present invention is only 39.6 g and the weight of the conventional wheel of the same dimension is 75.7 g. Thus the weight of the wheel of the present invention is reduced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wheel for an in-line skate, the wheel comprising:

a hub composed of two halves each having an inner side face and a conical outer side face, each half having a centrally defined axle hole, a hollow cylinder formed on a periphery defining the axle hole, multiple rods formed on the inner side face, multiple indents defined in the inner side face and alternate relative to the rods and a skirt formed on the outer periphery of the inner side face and having multiple segmented protrusions formed on a face of the skirt, multiple cutouts defined in the face of the skirt and alternate relative to the segmented protrusions and slits defined in the face of the skirt; and a tire securely mounted on an outer periphery of the hub, whereby the rods from one half are inserted into the indents of the other half and the segmented protrusions from one half are inserted into the cutouts of the other half and the assembly of the wheel is accomplished.

2. The wheel as claimed in claim 1, wherein the rods and the indents are formed on a top face of the hollow cylinder and the indents are alternate relative to the rods.

3. The wheel as claimed in claim 2 further having multiple reinforcing plates each formed along an outer periphery of the hollow cylinder and extended to an outer periphery of the inner side face.

4. The wheel as claimed in claim 1, wherein multiple secondary cylinders are formed on the inner side face of each of the two halves and the rods and the indents are formed on free ends of the secondary cylinders.

5. The wheel as claimed in claim 4 further having multiple reinforcing plates each formed along an outer periphery of the hollow cylinder and extended to an outer periphery of the inner side face.

6. The wheel as claimed in claim 1 further having multiple reinforcing plates each formed along an outer periphery of the hollow cylinder and extended to an outer periphery of the inner side face.

* * * * *